US007201207B2

(12) United States Patent
Colston et al.

(10) Patent No.: US 7,201,207 B2
(45) Date of Patent: Apr. 10, 2007

(54) OVERHEAD SECTIONAL DOOR, HINGE AND ASSOCIATED METHOD

(75) Inventors: John A. Colston, Mason, OH (US); Jeffrey W. Stone, Lebanon, OH (US)

(73) Assignee: Clopay Building Products R&D Company, Inc., Mason, OH (US)

( * ) Notice: Subject to any disclaimer, the term of this patent is extended or adjusted under 35 U.S.C. 154(b) by 277 days.

(21) Appl. No.: 10/949,138

(22) Filed: Sep. 24, 2004

(65) Prior Publication Data

US 2006/0065374 A1 Mar. 30, 2006

(51) Int. Cl.
*E05D 15/12* (2006.01)

(52) U.S. Cl. ..... 160/201; 160/229.1

(58) Field of Classification Search ..... 160/201, 160/405, 229.1, 232, 199, 206, 213, 236; 16/221, 387

See application file for complete search history.

(56) References Cited

U.S. PATENT DOCUMENTS

| | | | | |
|---|---|---|---|---|
| 1,994,142 | A | 3/1935 | Madsen | |
| 2,525,309 | A * | 10/1950 | Norberg | 16/97 |
| 3,198,242 | A | 8/1965 | Crosswell | |
| 3,334,681 | A | 8/1967 | Crosswell | |
| 3,376,913 | A * | 4/1968 | Clapsaddle | 160/201 |
| 3,484,812 | A * | 12/1969 | Holland | 160/201 |
| 3,608,613 | A | 9/1971 | Halliwell | |
| 4,156,448 | A * | 5/1979 | Bengtsson | 160/232 |
| 4,284,119 | A * | 8/1981 | Martin et al. | 160/232 |
| 4,379,478 | A | 4/1983 | Lichy | |
| 4,498,660 | A | 2/1985 | Brema et al. | |
| 4,749,018 | A | 6/1988 | Alten | |
| 4,893,666 | A | 1/1990 | Hormann | |

(Continued)

OTHER PUBLICATIONS

Novoferm, *Prazise Im Detail*, p. 9, undated.

(Continued)

*Primary Examiner*—David Purol
(74) *Attorney, Agent, or Firm*—Wood, Herron & Evans, LLP

(57) ABSTRACT

An overhead door and associated mating panels includes a number of hinges to pivotally couple adjacent overhead door panels. Each door panel includes a back metal skin presenting a back face. Each hinge includes a lower hinge leaf a pair of hinge legs projecting generally parallel to each other. The lower hinge leaf is mounted to the lower panel and a backer plate is mounted to the interior face of the back skin of the lower panel and screws or bolts project through the lower hinge leaf, the skin and into the backer plate. Each hinge leg on the lower hinge leaf includes a hinge pin hole near a terminal end thereof for alignment with the hinge pin holes in an upper hinge leaf. The lower hinge leaf has a tongue projecting from an upper edge of the mounting base. The tongue is formed into a hook-shaped arcuate projection and aids in the alignment, support and positioning of a hinge pin inserted through the aligned hinge pin holes in the upper and lower hinge leaves. A depression or pocket is provided in the back skin of the lower panel for each hinge assembly. The pocket provides a recess for the terminal ends of the hinge legs of the upper and lower hinge leaves. The shape or contour of the wells of the pocket provides a location or alignment benefit to the positioning of the lower hinge leaf.

44 Claims, 6 Drawing Sheets

U.S. PATENT DOCUMENTS

| | | | |
|---|---|---|---|
| 4,930,561 | A | 6/1990 | Clay |
| 4,989,660 | A | 2/1991 | Wagner |
| 4,991,639 | A | 2/1991 | Clay, Jr. et al. |
| 5,002,114 | A | 3/1991 | Hormann |
| 5,170,832 | A | 12/1992 | Wagner |
| 5,553,651 | A | 9/1996 | Olsen |
| 5,622,012 | A | 4/1997 | Schijf |
| 5,765,895 | A | 6/1998 | Rose et al. |
| 5,782,283 | A | 7/1998 | Kendall |
| 5,921,307 | A | 7/1999 | Ford et al. |
| 5,927,369 | A | 7/1999 | Pedersen |
| 5,934,352 | A | 8/1999 | Morgan |
| 6,076,590 | A | 6/2000 | Ford et al. |
| 6,098,697 | A | 8/2000 | Krupke et al. |
| 6,112,799 | A | 9/2000 | Mullet et al. |
| 6,328,091 | B1 | 12/2001 | Whitley |
| 6,363,993 | B1 | 4/2002 | Aquilina |
| 6,408,486 | B1 | 6/2002 | Saliba et al. |
| 6,463,988 | B1 | 10/2002 | Mullet et al. |
| 6,578,619 | B2 | 6/2003 | Wright |
| 6,626,226 | B2 | 9/2003 | Whitley |
| 6,629,387 | B2 | 10/2003 | Whitley et al. |
| 6,640,872 | B1 | 11/2003 | Mullet |
| 2003/0029582 | A1 | 2/2003 | Aquilina |
| 2003/0192658 | A1 | 10/2003 | Kendall et al. |
| 2003/0201078 | A1 | 10/2003 | Mullet |
| 2003/0221802 | A1 | 12/2003 | Whitley et al. |
| 2003/0230390 | A1 | 12/2003 | Martin |
| 2004/0016520 | A1 | 1/2004 | Whitley |

OTHER PUBLICATIONS

Novoferm, *Always on the safe side—perfectly equipped and easily mounted*, p. 3, undated.

* cited by examiner

OVERHEAD SECTIONAL DOOR, HINGE AND ASSOCIATED METHOD

BACKGROUND OF THE INVENTION

This invention relates to overhead doors and, more particularly, to overhead sectional door panels, the hinge assemblies for connecting the door panels and the associated method of manufacturing such systems.

There are numerous designs of overhead or retractable door assemblies which are commonly used for garage doors, truck doors, warehouse doors or the like. Typically, an overhead door of this type is convertible between an open, overhead or generally horizontal position and a closed generally vertically oriented position in which the door closes an opening in the building or the like. The overhead door is typically movable along a track assembly mounted proximate the opening and the track assembly commonly includes a generally vertical track section, a generally horizontal track section and a curved transition track section joining the horizontal and vertical sections together.

Retractable overhead doors of this type are conventionally constructed of a number of vertically arranged, horizontally oriented panels which can fold along the horizontal divisions between the panels to enable the door to pass along the curved transition section of the track when being opened or closed. The panels can be pivotally coupled together with hinges on the interior surface or back face of the door panels. Commonly, gaps appear between the adjacent panels while the panels are traveling toward and/or through the curved transition section of the track. Additionally, the hinges articulate during pivotal movement of the panels and gaps or spaces relative to the hinge assembly change, close and/or constrict. Foreign objects could be inserted into these gaps by accident or due to improper handling of the door which could result in damage to the door and/or the obstructing object.

Recently, many different overhead door, panel and hinge designs have been suggested which are aimed at addressing this situation. These types of door designs often include complicated structures which cover the gaps between the articulating panels or complicated panel and hinge designs to minimize or inhibit the insertion of a probe or other foreign object between the adjacent articulating panels. One beneficial design to minimize the gaps between adjacent panels is disclosed in U.S. Pat. No. 6,006,817, assigned to the assignee of this invention and hereby incorporated by reference in its entirety.

Nevertheless, while the invention in the above-identified patent offers significant advantages and benefits, overhead door manufacturers commonly offer a variety of panel designs spanning a range of commercial and residential applications and design objectives. The advantages provided by the inventions shown in U.S. Pat. No. 6,006,817 should be made available for other door panel configurations, such as fully insulated door panels having front and back skins and insulation sandwiched there between. Preferably, these objectives should be attained without sacrificing the integrity of the panel and the optimum operation and performance of the overhead door system.

Moreover, the secure and efficient assembly of such door systems and the installation of the hinges on the door panels continues to be an important objective for designers, manufacturers and installers alike.

Therefore, there is a need in the industry for an improved overhead door and associated panels and hinge assemblies which minimizes the opportunity for the insertion of foreign objects and the resulting damage relative to the hinge assemblies and associated components for a wider range of door panel designs while maximizing the efficient and reliable manufacture, assembly and installation of such systems.

SUMMARY OF THE INVENTION

The various embodiments of this invention offer these and other advantages over known overhead door, panel and hinge designs. In one embodiment, this invention includes a number of horizontally oriented panels vertically stacked one upon the other in edge-to-edge relationship.

The panels are coupled to a track assembly mounted proximate the garage, warehouse, truck or other opening. The track assembly includes a generally vertical section, a generally horizontal section and a curved transition section joining the horizontal and vertical sections together. Rollers are mounted on the panels and coupled to the track assembly to guide the door between a closed generally vertical position with the upper and lower edges of the adjacent panels mated together and an open generally horizontal position extending generally parallel to the ceiling of the garage or the like.

One aspect of this invention includes a hinge assembly designed to pivotally couple adjacent overhead door panels. Each door panel includes a front metal skin presenting an exterior front face and a back metal skin presenting an interior back face. The panels in one embodiment are filled with a foam or other insulating material. The panels each have mating upper and lower edges that in one embodiment have generally convex and concave profiles to mate with each other during the operation of the door. One example of the profile of the mating upper and lower edges is described in U.S. Pat. No. 6,006,817, assigned to the assignee of this invention and hereby incorporated by reference in its entirety.

The door panels are pivotally connected together by a series of hinges along the adjacent edges. The hinge assembly according to one embodiment of this invention includes an upper hinge leaf bolted, screwed or otherwise secured along its base plate to the back skin or back face of an upper panel. The upper hinge leaf includes a pair of spaced generally parallel flanges or hinge arms which project rearwardly and perpendicularly away from the base plate to span the juncture between the upper and lower panels. Each hinge arm projects toward the back face of the lower panel. Each of the hinge arms includes a hinge pin hole near a terminal end thereof.

The hinge assembly also includes a lower hinge leaf that has a generally U-shaped profile with a pair of flanges or hinge legs projecting generally parallel to each other and perpendicular to its mounting base. The lower hinge leaf is bolted, screwed or otherwise mounted to the lower panel. A backer plate is mounted to the interior face of the back skin of the lower panel and screws or bolts project through the mounting base of the lower hinge leaf, the skin and into the backer plate. Each hinge leg on the lower hinge leaf includes a hinge pin hole near a terminal end thereof for alignment With the hinge pin holes in the hinge arms of the upper leaf. The lower hinge leaf has a tongue projecting from an upper edge of the mounting base. The tongue is formed into a hook-shaped arcuate projection. This tongue does not loop around or surround the pin and aids in the alignment, support and positioning of a hinge pin inserted through the aligned hinge pin holes in the flanges of the upper and lower hinge leaves.

A rectangular-shaped depression or recessed pocket is provided in the back skin of the lower panel for each hinge assembly. The pocket provides a recess for the terminal ends of the hinge arms and hinge legs of the upper and lower hinge leaves. In one embodiment of the hinge assembly, while the hinge legs/arms extend into pocket in the lower panel, the hinge pin and associated pivot axis is generally aligned with the plane of the mounting base and base plate of the lower and upper hinge leaves when the door is in the closed generally vertical position. However, the hinge pin and associated pivot axis may be adjusted so that it is at least partially inserted into the pocket in the back face of the panel.

The pocket includes a central elongate channel, a pair of wells or depressions all of which combine to form a generally H-shaped recess for each hinge assembly. One aspect of the pocket in the back skin of the lower panel is that the shape or contour of the wells of the pocket provides a location or alignment benefit to the positioning of the lower hinge leaf. Specifically, the profile or shape of each hinge leg on the lower hinge leaf corresponds generally to the shape and size of the associated well in the pocket so that when the lower hinge leaf is initially positioned on the back skin of the lower panel, the position of the hinge leaf, particularly relative to the juncture between the adjacent panels, is initially established by the contours of the flanges and associated wells of the pocket. In other words, the vertical position of the lower hinge leaf is initially established by the flanges being inserted into the wells.

The lower hinge leaf is then bolted or screwed to the lower panel as previously described.

Another aspect of this invention is the backer plate. Specifically, when the pocket and associated wells and channel are formed in the back skin material, the backer plate is likewise positioned in face-to-face relationship to the back or interior face of the back skin. When the pocket is formed in the back skin and particularly the channel portion of the pocket, the backer plate is likewise formed to include a channel, recess or depression. The simultaneous forming of the depressions or channels in the back skin and the backer plate provides for more efficient manufacturing of the components of this invention.

As a result, the overhead sectional door, hinge and associated methods of manufacturing, assembling and installing the door provides the benefits of efficiency and reliability in a pinch-resistant sandwich door panel construction.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
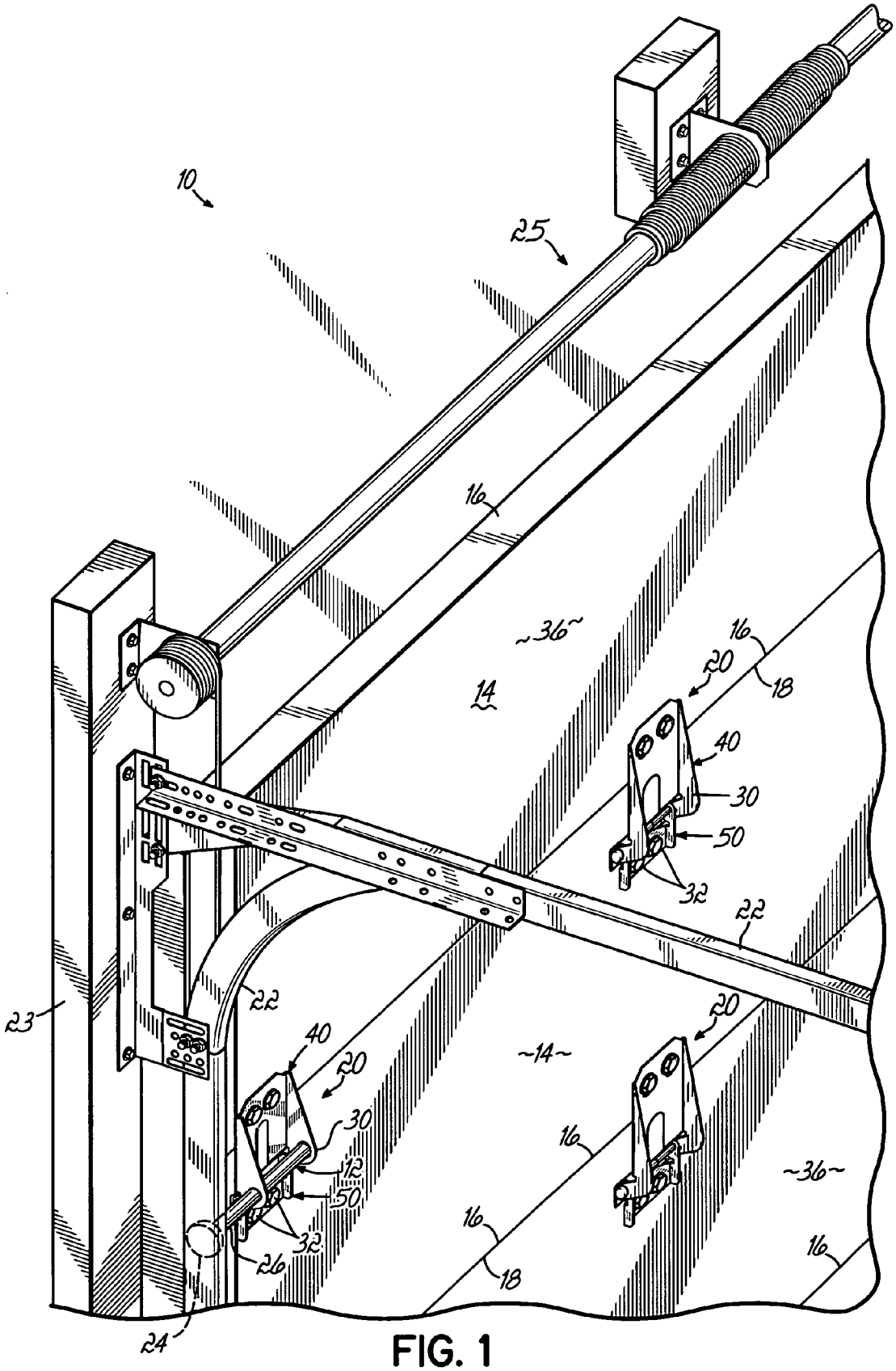
FIG. 1 is a perspective view of an overhead door with hinge assemblies according to one embodiment of this invention.

Referring to FIG. 1, a presently preferred embodiment of a portion of an overhead door 10 according to this invention is shown in a closed generally vertical position covering an opening in a wall (not shown) of a garage, warehouse or the like. The door 10 includes a number of panels 14. Each panel 14 includes upper and lower generally horizontally oriented edges 16, 18 which are configured to mate with the lower and upper edges 18, 16 respectively, of an adjacent panel 14 when the door 10 is in the closed position as shown in FIG. 1.

The adjacent panels 14 are pivotally connected together by a number of hinge assemblies 20. The hinges 20 proximate the lateral side ends of each panel 14 include a roller assembly 12 (FIG. 6) for coupling the door 10 to a track assembly 22. The opening and closing of the door 10 may be assisted by a counterbalance system 25 coupled to the door 10 as is well known in the art.

Figure 6:
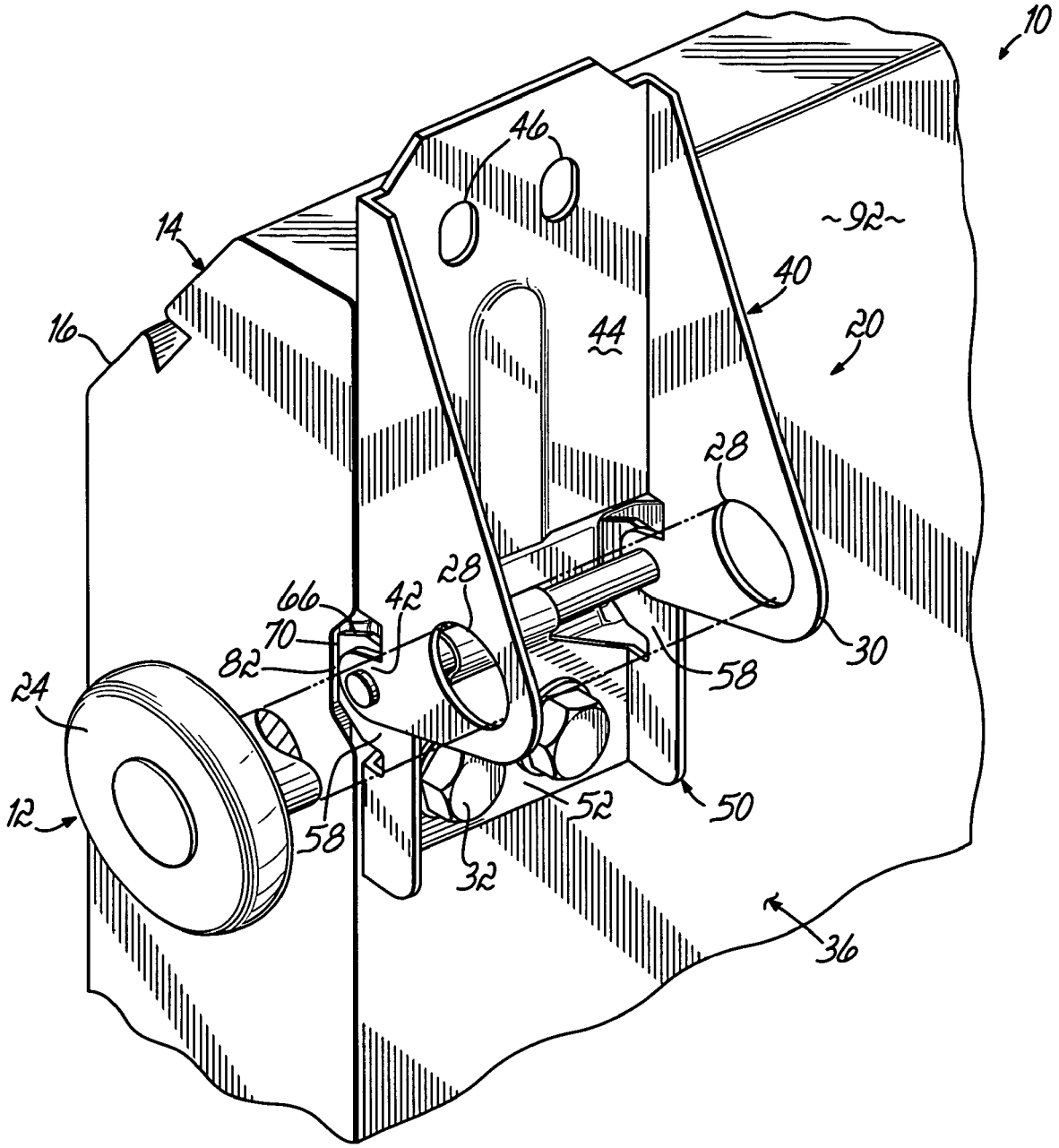
FIG. 6 is a perspective view of a hinge assembly and roller installed adjacent a lateral side edge of the door panel of one embodiment of this invention.

As shown in FIG. 6, the hinge assemblies 20 which are located adjacent to the track assembly are adapted to receive the shaft 26 of a roller 24 for coupling the door panels 14 to the track assembly 22. The track assembly 22 is mounted to a wall jamb 23 adjacent the door opening. The roller assemblies 12 each include a roller 24 mounted for rotation on a shaft 26 seated in holes 28 in upright tabs 30 of each hinge 20. The hinges 20 are mounted on the panels 14 with fasteners such as screws or bolts 32 and the roller assemblies 12 couple to the track assembly 22 to guide the door 10 between the closed and open configurations.

Figure 4:
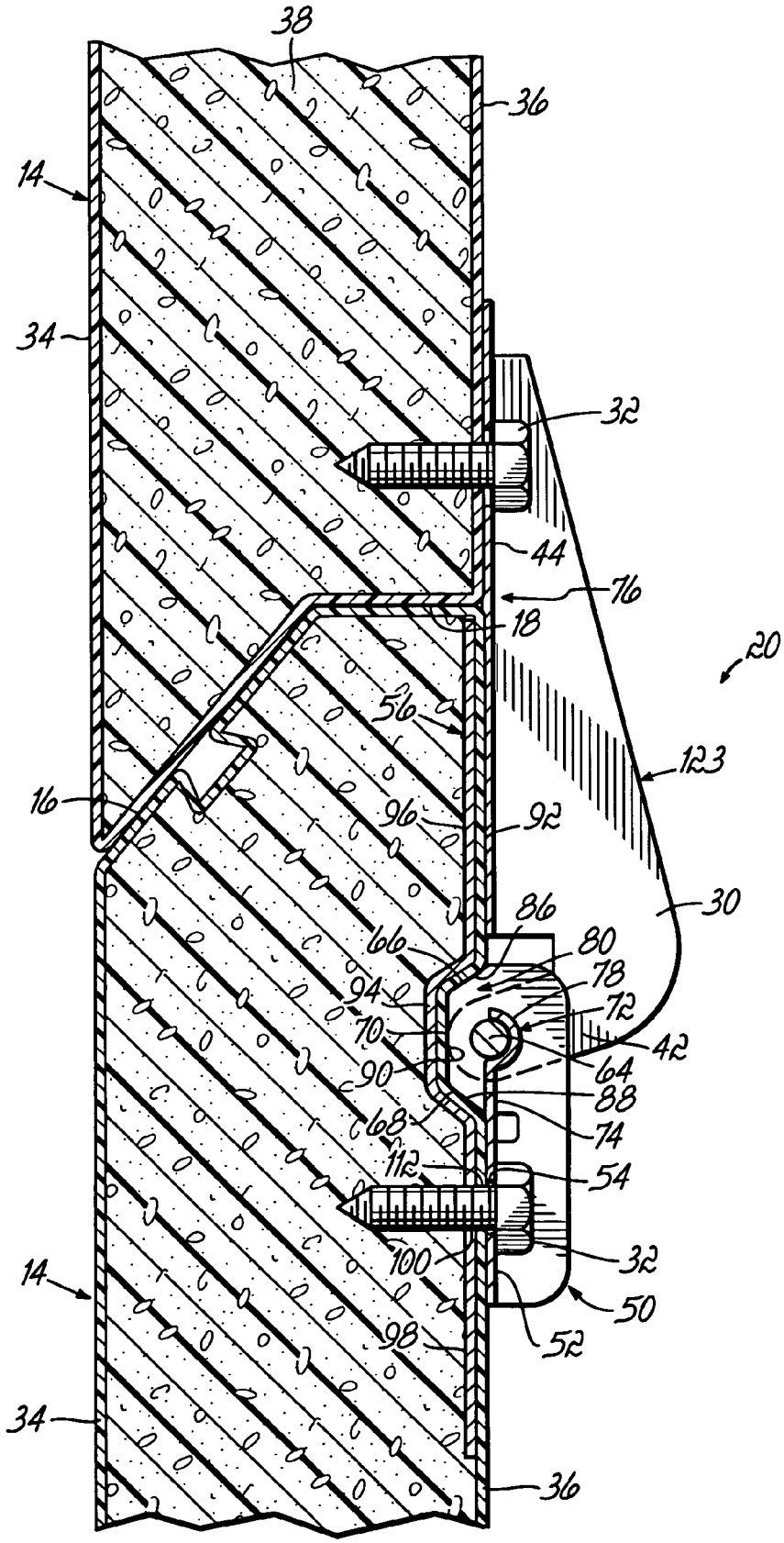
FIG. 4 is a cross-sectional view taken along line 4—4 of FIG. 3.

Referring to FIG. 4, lower edge 18 of each panel 14 is, according to a presently preferred embodiment of this invention, generally concave for mating with the upper generally convex-shaped edge 16 of an adjacent panel 14. A more detailed disclosure of the edge 16, 18 position according to one embodiment of this invention is found in U.S. Pat. No. 6,006,817, assigned to the assignee of this invention and hereby incorporated by reference in its entirety. Nevertheless, this invention is readily employed on a panel design of another configuration.

Referring particularly to FIGS. 1, 3, 4, and 16 each panel 14 according to one embodiment in this invention includes a front skin 34 defining Referring particularly to FIGS. 1, 3, 4, and 6 each panel 14 according to one embodiment in this invention includes a front skin 34 defining a front face of the panel 14 and a back skin 36 defining a back face of the panel 14. Generally, each of the skins 34, 36 are relatively thin embossed sheet metal according to presently preferred embodiments of the invention as is well known in the industry. The front and back skins 34, 36 of the panels 14 may be formed from a single piece of sheet metal or individual, separate sheet metal skins which are joined together or juxtaposed to one another to provide the panel configuration. Insulation 38 is preferably provided to fill the internal volume defined by the front and back skins 34, 36 as is well known in the art.

The hinge assembly 20, according to a presently preferred embodiment of this invention, includes a first hinge leaf 40 which is attached to the back skin 36 proximate the lower edge 18 of an upper panel 14. The hinge leaf 40 includes a pair of spaced and parallel generally L-shaped arms 42 between which a base plate 44 is positioned. The hinge leaf 40 is attached to the superjacent panel 14 by bolts, screws or other mechanical fasteners 32 through holes 46 in the base plate 44.

Each hinge 20 also includes a second hinge leaf 50 secured by mechanical fasteners such as screws or bolts 32 to the lower subjacent panel 14. The second hinge leaf 50 has a generally U-shaped cross-sectional configuration with a central mounting base 52 having a pair of holes 54 through which the fasteners 32 project for insertion into and through the back skin 36 of the panel 14. Preferably, a backer plate 56 is positioned on the interior face of the back skin 36 and aligned with the hinge 20 for insertion of the fasteners 32 through the back 36 skin and to the backer plate 56 to provide secure and stable mounting of the hinge assembly 20 to the panel 14.

The lower hinge leaf 50 includes a pair of flanges or hinge legs 58 projecting generally perpendicularly from each lateral side edge of the mounting base 52. A terminal portion of each hinge leg 58 includes a hole 60 which is adapted to be aligned with a hole 62 in the hinge arm 42 of the upper hinge leaf 40 for a hinge pin 64 to be inserted through the aligned holes and pivotally couple the upper and lower hinge leaves 40, 50. Each hinge leg terminal portion as show most clearly in FIG. 4 includes a pair of tapered upper and lower edges 66, 68 and an intermediate edge 70 juxtaposed around the hinge pin hole 60 in the hinge leg 58.

Figure 2:
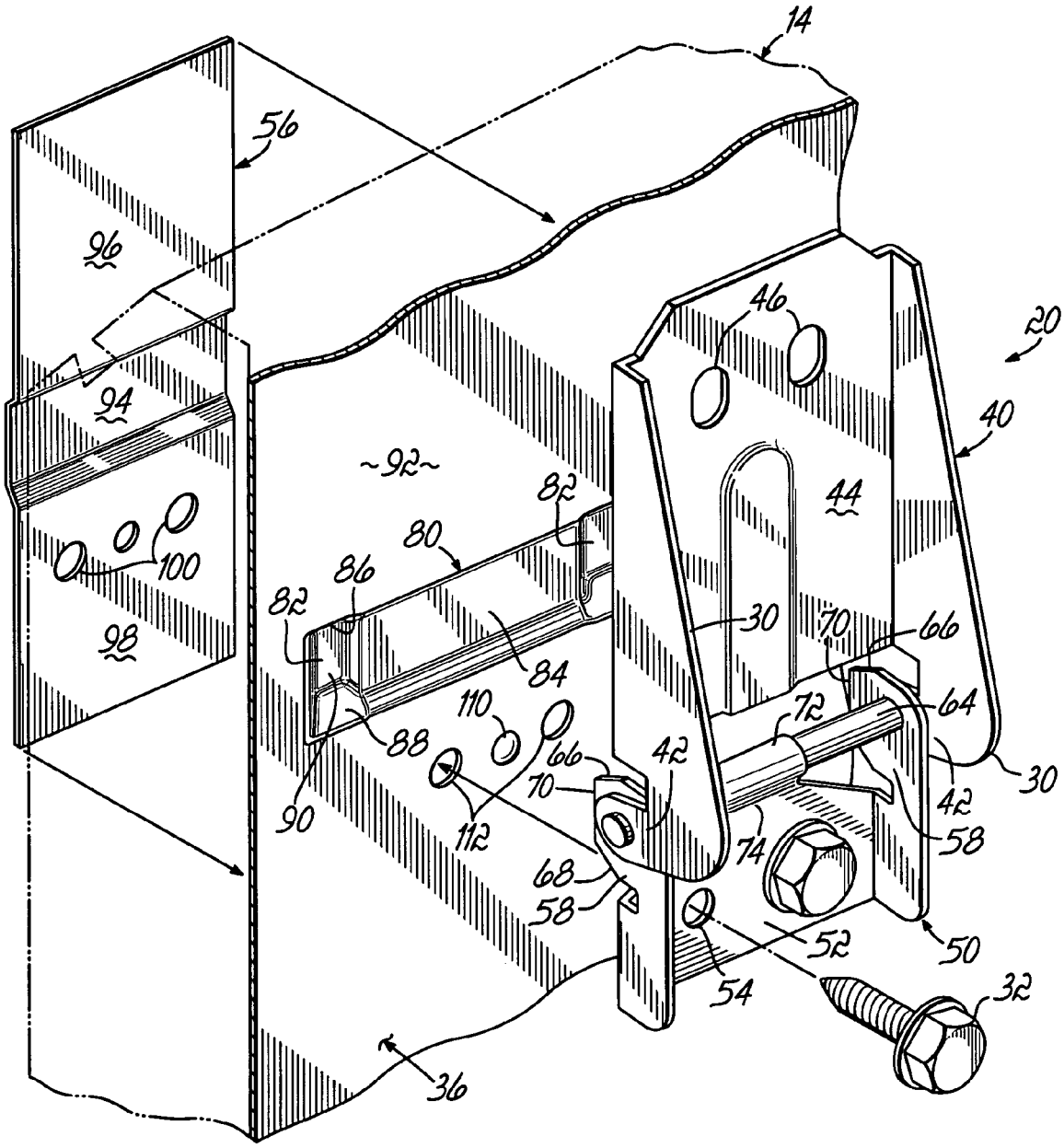
FIG. 2 is an exploded perspective view of the components of a hinge assembly of FIG. 1 being installed.
Figure 3:
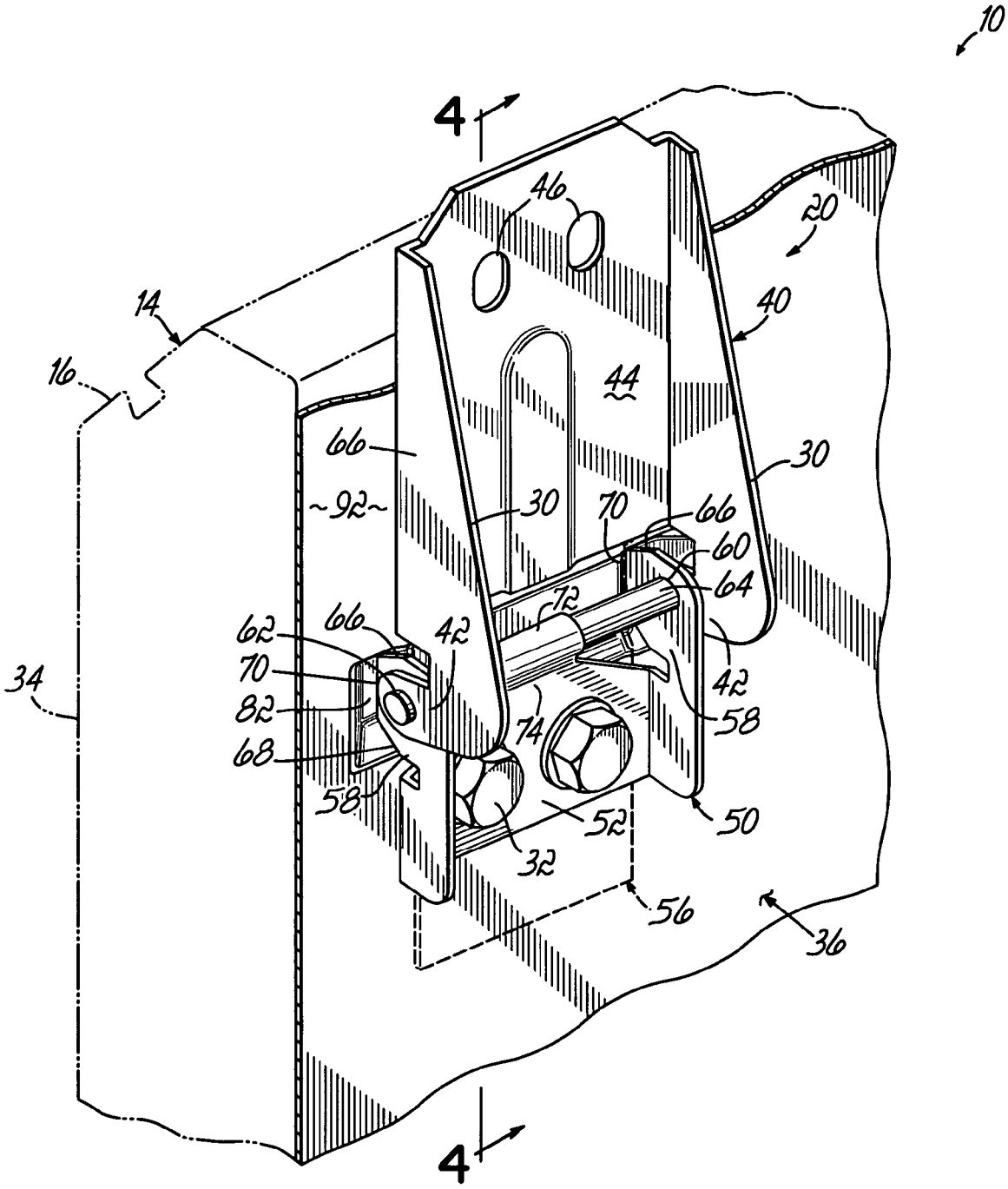
FIG. 3 is a view similar to FIG. 2 of the installed hinge assembly.

A tongue 72 projects from the upper edge 74 of the mounting base 52 of the hinge leaf 50 toward the juncture 76 between the edges 16,18 of the adjacent panels 14. The tongue 72 has a generally arcuate-shaped profile along the terminal portion 78 thereof which is adapted to at least partially wrap around the hinge pin 64 when installed with the upper and lower hinged leaves 40, 50. As shown in FIG. 4, the tongue 72 does not entirely surround the perimeter of the hinge pin 64 but stabilizes, proportions and aligns the pin 64 of the hinge assembly 20. Preferably the tongue 72 is located between the hinge legs 58 of the lower hinge leaf 50 and spaced from each of the hinge legs 58 as shown generally in FIGS. 2 and 3.

As can be readily seen in FIG. 4, the hinge pin 64 provides a pivot axis for the hinge assembly 20 which is located inwardly of the back face 36 of the panel 14. Advantageously, positioning the hinge pin 48 and pivot axis of the hinge 20 inwardly from the back faces 36 of the panels 14 helps to minimize the spacing between the upper and lower edges 16, 18 of the adjacent panels 14 during articulation of the panels 14 while opening and closing the door 10.

Another aspect to the overhead sectional door hinge and associated method according to this invention is a recessed pocket 80 formed in the back skin 36 of each door panel 14 for each hinge assembly 20. The recessed pocket 80 provides for positioning the hinge pin 64 and pivot axis of the hinge 20 inwardly from the back faces of the panels 14 without interrupting the structural integrity of the back skin 36.

In one embodiment, the recessed pocket 80 is formed integrally from the material of the back skin 36 and includes a pair of spaced wells 82 separated by a depressed channel 84 portion. Each of the wells 82 are generally rectangular-shaped and include upper and lower sloped end walls 86, 88 positioned on the upper and lower edges of a well bottom wall 90 as shown in FIG. 4. The shape, configuration and sizing of the wells 82 and associated walls 86, 88, 90 is designed to be compatible and mate with the shape, configuration and sizing of the terminal portion of the hinge leg 58 so as to provide a secure and accurate positioning of the lower hinge leaf 50 vertically relative to the juncture 76 between the adjacent panels 14. As a result, very little spacing is provided between the tapered upper and lower edges 66, 68 of the terminal portion of the hinge leg 58 and the juxtaposed sloped end walls 86, 88 of the well 82 into which the hinge leg 58 is positioned.

The recessed pocket 80 is spaced from the juncture 76 between the adjacent panels 14 such that a header portion 92 of the back skin 36 is located between the juncture 76 and the recessed pocket 80 to provide for proper positioning of the hinge pin 64 and associated pivot axis of the hinge 20 to compliment the shape and configuration of the upper and lower edges 16, 18 of the panels and minimize the exposed spacing between the panel edges 16, 18 during articulation of the overhead door 10 to and between the closed and open configurations.

Preferably, the backer plate 56 juxtaposed to the interior surface of the back skin 36 likewise includes a depressed furrow 94 separating an upper and lower backer plate portions from one another. The lower portion 98 of the backer plate 56 includes a pair of holes 100 sized and aligned with the holes 54 in the mounting base 52 of the lower hinge leaf 50 and holes 112 in the back skin 36 to receive and mount the fasteners 32. Preferably, the furrow 94 of the backer plate 56 is sized and configured to be compatible with the contour of the recessed pocket 80 in the back skin 36. In the embodiment shown in FIG. 2, the width of the backer plate 56 fits between the spaced wells 82 in the back skin 36. As such, the furrow 94 mates with the depressed channel 84 on the interior side of the back skin 36.

Figure 5A:
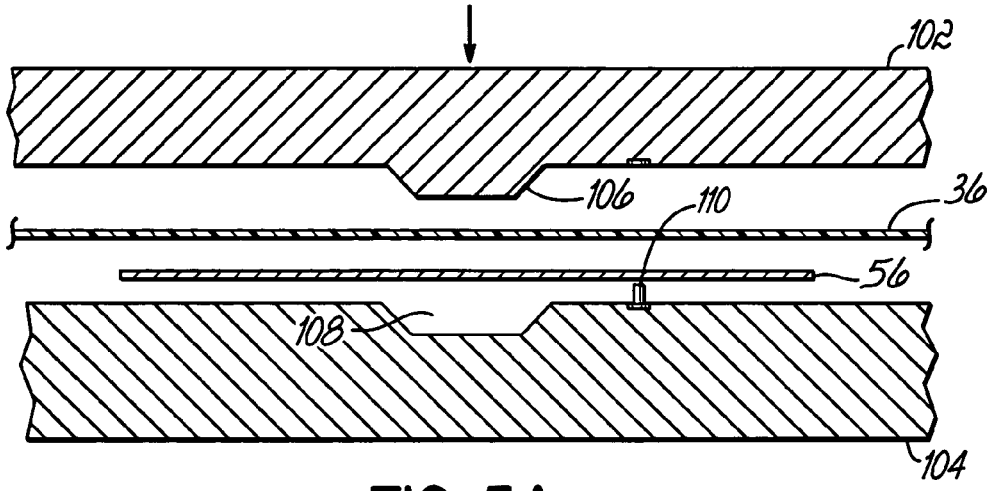
FIGS. 5A–5C are sequential views of a method of stamping the back skin and backer plate of this invention.
Figure 5B:
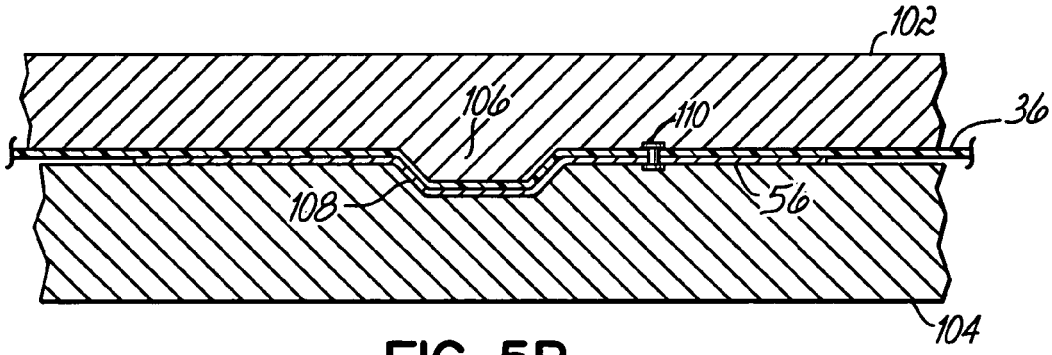
Figure 5C:
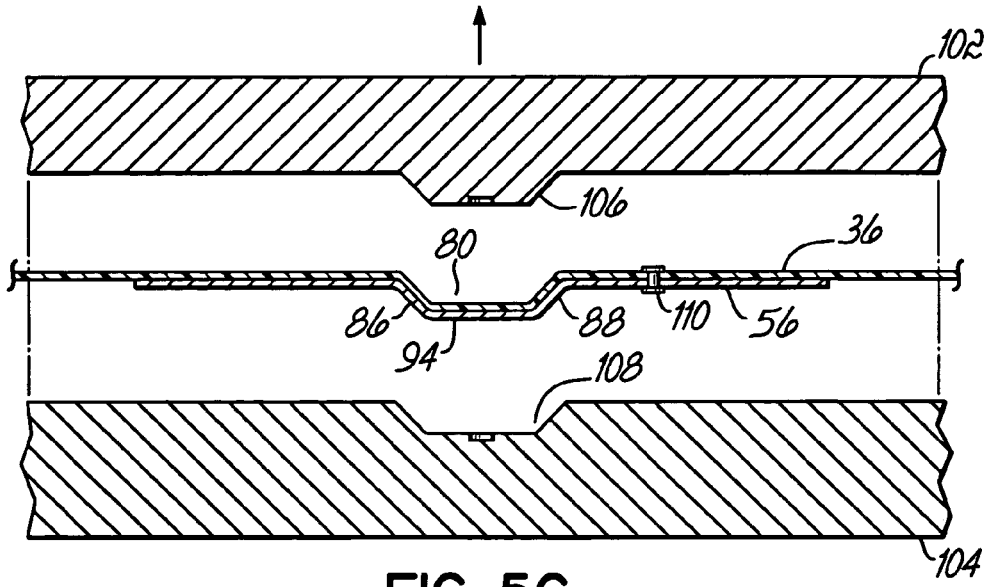

Another aspect of this invention is the simultaneous forming of the furrow 94 and recessed pocket 80 during the manufacture of the door panel 14 according to this invention. As shown in FIGS. 5A–5C, upper and lower forming dies 102,104 simultaneously form the furrow 94 and pocket 80 in the backer plate and back skin material. The dies 102,104 have mating male and female patterns 106, 108 therein, respectively, to form the furrow 94 and pocket 80. A rivet or other fastening mechanism may be included to accurately position and secure the backer plate 56 relative to the back skin 36 of the panel 14 before, during and after the forming of the furrow 94 and recessed pocket 80. In one preferred embodiment, a Tog-L-Loc® technique available from the BTM Corporation (www.BTMCORP.com) is used to join the backer plate 56 and back skin 36 material.

It should be readily appreciated that although certain embodiments and configurations of the invention are shown and described herein, the invention is not so limited. From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. An overhead door capable of being selectively moved between a generally horizontal open position and a generally vertical closed position covering an opening, the door comprising:

a plurality of serially connected panels each having a front face and a back face;

a track assembly mounted proximate the opening, the track assembly including a generally vertical section, a generally horizontal section and a transition section joining the horizontal and vertical sections together;

a plurality of rollers mounted on the panels and coupled to the track assembly to guide the door between the closed and open positions;

at least one hinge assembly mounted to the respective back faces of adjacent panels, wherein each hinge assembly further comprises:

(a) a first hinge leaf and a second hinge leaf each secured to one of the adjacent panels of the door;

(b) at least one hinge arm projecting from the first hinge leaf to span a juncture between the adjacent panels;

(d) at least one hinge leg projecting from the second hinge leaf;

(e) a hinge coupled to the hinge arm and the hinge leg of the respective hinge leaves to thereby pivotally couple the hinge leaves and associated panels; and (f) a tongue projecting from the second hinge leaf and engaging the hinge pin in-board of the hinge arm to retain the hinge pin.

2. The overhead door of claim 1 wherein a terminal portion of the tongue is arcuate shaped.

3. The overhead door of claim 1 wherein the tongue only partially surrounds the hinge pin.

4. The overhead door of claim 1 further comprising a pair of the hinge arms and a pair of the hinge legs projecting from the first and second hinge leaves, respectively.

5. The overhead door of claim 1 further comprising a plurality of hinge pin holes through which the hinge pin projects, each hinge pin hole being in one of the hinge arms and hinge legs.

6. The overhead door of claim 4 wherein the hinge legs are spaced from each other and positioned on opposite sides of the tongue.

7. The overhead door of claim 1 wherein the tongue projects from a base of the second hinge leaf and toward the juncture between the adjacent panels.

8. The overhead door of claim 1 further comprising:

a recessed pocket in the back face of one of the adjacent panels, the hinge legs of the second hinge leaf being seated in the recessed pocket.

9. The overhead door of claim 8 further comprising:

a back skin on each of the panels, the back skin defining the back face of the panels;

wherein the pocket is formed in the back skin.

10. The overhead door of claim 8 wherein the recessed pocket is spaced from the juncture between the adjacent panels.

11. The overhead door of claim 8 wherein the hinge pin is positioned at least partially within the pocket.

12. The overhead door of claim 8 wherein the pocket positions the second hinge leaf relative to the juncture between the adjacent panels.

13. The overhead door of claim 1 wherein the tongue is spaced from each of the hinge legs on the second hinge leaf.

14. The overhead door of claim 1 wherein the tongue projects generally perpendicularly to the orientation of the hinge leg on the second hinge leaf.

15. The overhead door of claim 1 further comprising:

a back skin on each of the panels, the back skin defining the back face of the panels; and a backer plate positioned on an interior surface of the back skin opposite from the back face, the second hinge leaf being secured to the backer plate with a portion of the back skin sandwiched there between.

16. The overhead door of claim 15 further comprising:

a recessed pocket in the back face of one of the adjacent panels, the hinge legs of the second hinge leaf being seated in the recessed pocket.

17. An overhead door capable of being selectively moved between a generally horizontal open position and a generally vertical closed position covering an opening, the door comprising:

a plurality of serially connected panels each having a front face and a back face;

a track assembly mounted proximate the opening, the track assembly including a generally vertical section, a generally horizontal section and a transition section joining the horizontal and vertical sections together;

a plurality of rollers mounted on the panels and coupled to the track assembly to guide the door between the closed and open positions;

a back skin on each of the panels, the back skin defining the back face of the panels;

a backer plate positioned on an interior surface of the back skin opposite from the back face, the second hinge leaf being secured to the backer plate with a portion of the back skin sandwiched there between; and at least one hinge assembly mounted to the respective back faces of adjacent panels, wherein each hinge assembly further comprises;

(a) a first hinge leaf and a second hinge leaf each secured to one of the adjacent panels of the door;

(b) at least one hinge arm projecting from the first hinge leaf to span a juncture between the adjacent panels;

(d) at least one hinge leg projecting from the second hinge leaf;

(e) a hinge pin coupled to the hinge arm and the hinge leg of the respective hinge leaves to thereby pivotally couple the hinge leaves and associated panels;

(f) a tongue projecting from the second hinge leaf to retain the hinge pin;

(g) a recessed pocket in the back face of one of the adjacent panels, the hinge legs of the second hinge leaf being seated in the recessed pocket; and (h) a depression channel in the backer plate sized and configured to mate with at least a portion of the pocket when the backer plate and back skin are juxtaposed together.

18. The overhead door of claim 8 wherein selected hinge assemblies are positioned on the panels and adjacent the track assembly, the selected hinge assemblies further comprising:

a roller mount for mounting one of the rollers thereto.

19. The overhead door of claim 18 wherein the roller mount further comprises a hole in the hinge arm through which a shaft of the roller is mounted.

20. An overhead door capable of being selectively moved between a generally horizontal open position and a generally vertical closed position covering an opening, the door comprising:

a plurality of serially connected panels each having a front face and a back face;

a track assembly mounted proximate the opening, the track assembly including a generally vertical section, a generally horizontal section and a transition section joining the horizontal and vertical sections together;

a plurality of rollers mounted on the panels and coupled to the track assembly to guide the door between the closed and open positions;

at least one hinge assembly mounted to the respective back faces of adjacent panels, wherein each hinge assembly further comprises:

(a) a first hinge leaf and a second hinge leaf each secured to one of the adjacent panels of the door;

(b) a pair of spaced hinge arms projecting from the first hinge leaf to span a juncture between the adjacent panels;

(d) a pair of spaced hinge legs projecting from the second hinge leaf;

(e) a hinge pin hole in each of the hinge legs and each of the hinge arms;

(f) a hinge pin pivotally coupling the hinge leaves and being inserted through the hinge pin holes in the hinge arms and the hinge legs; and (g) a tongue projecting from the second hinge leaf and between the spaced hinge arms to retain the hinge pin, a terminal portion of the tongue being arcuate shaped and only partially surrounding the hinge pin.

21. The overhead door of claim 20 wherein the tongue projects from a base of the second hinge leaf and toward the juncture between the adjacent panels and is oriented generally perpendicularly to the hinge legs.

22. The overhead door of claim 20 further comprising:

a back skin on each of the panels, the back skin defining the back face of the panels; and a recessed pocket in the back skin of one of the adjacent panels and spaced from the juncture between the adjacent panels, the hinge legs of the second hinge leaf being seated in the recessed pocket;

wherein the hinge pin is positioned at least partially within the pocket.

23. The overhead door of claim 22 wherein the pocket positions the second hinge leaf relative to the juncture between the adjacent panels.

24. The overhead door of claim 22 further comprising:

a backer plate positioned on an interior surface of the back skin opposite from the back face, the second hinge leaf being secured to the backer plate with a portion of the back skin sandwiched there between.

25. An overhead door capable of being selectively moved between a generally horizontal open position and a generally vertical closed position covering an opening, the door comprising:

a plurality of serially connected panels each having a front skin defining a front face and a back skin defining a back face;

a track assembly mounted proximate the opening, the track assembly including a generally vertical section, a generally horizontal section and a transition section joining the horizontal and vertical sections together;

a plurality of rollers mounted on the panels and coupled to the track assembly to guide the door between the closed and open positions;

at least one hinge assembly mounted to the respective back faces of adjacent panels and spanning a juncture between the adjacent panels to thereby pivotally couple the adjacent panels together;

at least one recessed pocket in the back skin of one of the adjacent panels and spaced from the juncture between the adjacent panels, a portion of each hinge assembly being seated within one of the pockets.

26. The overhead door of claim 25 wherein the pocket is formed integrally with the back skin.

27. The overhead door of claim 25 wherein the pocket positions the hinge assemblies relative to the juncture between the adjacent panels.

28. The overhead door of claim 25 further comprising:

at least one backer plate positioned on an interior surface of the back skin opposite from the back face, each hinge assembly being secured to a respective backer plate with a portion of the back skin sandwiched there between.

29. An overhead door capable of being selectively moved between a generally horizontal open position and a generally vertical closed position covering an opening, the door comprising:

a plurality of serially connected panels each having a front skin defining a front face and a back skin defining a back face;

a track assembly mounted proximate the opening, the track assembly including a generally vertical section, a generally horizontal section and a transition section joining the horizontal and vertical sections together;

a plurality of rollers mounted on the panels and coupled to the track assembly to guide the door between the closed and open positions;

at least one hinge assembly mounted to the respective back faces of adjacent panels and spanning a juncture between the adjacent panels to thereby pivotally couple the adjacent panels together;

at least one recessed pocket in the back skin of one of the adjacent panels and spaced from the juncture between the adjacent panels, a portion of each hinge assembly being seated within one of the pockets;

at least one backer plate positioned on an interior surface of the back skin opposite from the back face, each hinge assembly being secured to a respective backer plate with a portion of the back skin sandwiched there between; and a depression channel in each backer plate sized and configured to mate with at least a portion of the pocket when the backer plate and back skin are juxtaposed together.

30. The overhead door of claim 25 further comprising:

insulation sandwiched between the front and back skins.

31. The overhead door of claim 25 wherein each hinge assembly further comprises:

a first hinge leaf and a second hinge leaf each secured to one of the adjacent panels of the door;

a pair of spaced hinge arms projecting from the first hinge leaf to span a juncture between the adjacent panels;

a pair of spaced hinge legs projecting from the second hinge leaf;

a hinge pin hole in each of the hinge legs and each of the hinge arms; and a hinge pin pivotally coupling the hinge leaves and being inserted through the hinge pin holes in the hinge arms and the hinge legs.

32. The overhead door of claim 31 further comprising:

a tongue projecting from the second hinge leaf and between the spaced hinge legs to retain the hinge pin, a terminal portion of the tongue being arcuate shaped and only partially surrounds the hinge pin.

33. An overhead door capable of being selectively moved between a generally horizontal open position and a generally vertical closed position covering an opening, the door comprising:

a plurality of serially connected panels each having a front skin defining a front face and a back skin defining a back face;

a track assembly mounted proximate the opening, the track assembly including a generally vertical section, a generally horizontal section and a transition section joining the horizontal and vertical sections together;

a plurality of rollers mounted on the panels and coupled to the track assembly to guide the door between the closed and open positions;

at least one hinge assembly mounted to the respective back faces of adjacent panels and spanning a juncture between the adjacent panels to thereby pivotally couple the adjacent panels together;

at least one recessed pocket in the back skin of one of the adjacent panels and spaced from the juncture between the adjacent panels, a portion of each hinge assembly being seated within one of the pockets;

wherein each recessed pocket further comprises:

a pair of wells each adapted to receive therein a hinge leg extending from one of the hinge assemblies.

34. The overhead door of claim 33 wherein each recessed pocket further comprises:

a recessed channel interposed between the pair of wells, a depth of the channel being less than a depth of each well.

35. The overhead door of claim 33 wherein a profile of each well mates with a profile of each hinge leg to thereby position the hinge assembly relative to the juncture between the adjacent panels.

36. An overhead door capable of being selectively moved between a generally horizontal open position and a generally vertical closed position covering an opening, the door comprising:

a plurality of serially connected panels each having a front skin defining a front face and a back skin defining a back face;

a track assembly mounted proximate the opening, the track assembly including a generally vertical section, a generally horizontal section and a transition section joining the horizontal and vertical sections together;

a plurality of rollers mounted on the panels and coupled to the track assembly to guide the door between the closed and open positions;

a plurality of hinge assemblies each mounted to the respective back faces of adjacent panels and spanning a juncture between the adjacent panels to thereby pivotally couple the adjacent panels together;

a plurality of backer plates each positioned on an interior surface of the back skin opposite from the back face, each hinge assembly being secured to one of the backer plates with a portion of the back skin sandwiched there between;

a plurality of recessed pockets integrally formed in the back skin of one of the adjacent panels and spaced from the juncture between the adjacent panels, a portion of each of the hinge assemblies being seated within one of the pockets;

wherein each pocket positions the associated hinge assemblies relative to the juncture between the adjacent panels.

37. An overhead door capable of being selectively moved between a generally horizontal open position and a generally vertical closed position covering an opening, the door comprising:

a plurality of serially connected panels each having a front skin defining a front face and a back skin defining a back face;

a track assembly mounted proximate the opening, the track assembly including a generally vertical section, a generally horizontal section and a transition section joining the horizontal and vertical sections together;

a plurality of rollers mounted on the panels and coupled to the track assembly to guide the door between the closed and open positions;

a plurality of hinge assemblies each mounted to the respective back faces of adjacent panels and spanning a juncture between the adjacent panels to thereby pivotally couple the adjacent panels together;

a plurality of backer plates each positioned on an interior surface of the back skin opposite from the back face, each hinge assembly being secured to one of the backer plates with a portion of the back skin sandwiched there between;

a plurality of recessed pockets integrally formed in the back skin of one of the adjacent panels and spaced from the juncture between the adjacent panels, a portion of each of the hinge assemblies being seated within one of the pockets wherein each pocket positions the associated hinge assemblies relative to the juncture between the adjacent panels; and a depression channel in each backer plate sized and configured to mate with at least a portion of the pocket when the backer plate and back skin are juxtaposed together.

38. The overhead door of claim 36 further comprising:

a tongue projecting from a hinge leaf and between spaced hinge legs to retain a hinge pin, a terminal portion of the tongue being arcuate shaped and only partially surrounding the hinge pin.

39. An overhead door capable of being selectively moved between a generally horizontal open position and a generally vertical closed position covering an opening, the door comprising:

a plurality of serially connected panels each having a front skin defining a front face and a back skin defining a back face;

a track assembly mounted proximate the opening, the track assembly including a generally vertical section, a generally horizontal section and a transition section joining the horizontal and vertical sections together;

a plurality of rollers mounted on the panels and coupled to the track assembly to guide the door between the closed and open positions;

a plurality of hinge assemblies each mounted to the respective back faces of adjacent panels and spanning a juncture between the adjacent panels to thereby pivotally couple the adjacent panels together;

a plurality of backer plates each positioned on an interior surface of the back skin opposite from the back face, each hinge assembly being secured to one of the backer plates with a portion of the back skin sandwiched there between;

a plurality of recessed pockets integrally formed in the back skin of one of the adjacent panels and spaced from the juncture between the adjacent panels, a portion of each of the hinge assemblies being seated within one of the pockets;

wherein each pocket positions the associated hinge assemblies relative to the juncture between the adjacent panels; and wherein each recessed pocket further comprises:

a pair of wells each adapted to receive therein a hinge leg extending from one of the hinge assemblies.

40. The overhead door of claim 39 wherein each recessed pocket further comprises:

a recessed channel interposed between the pair of wells, a depth of the channel being less than a depth of each well.

41. A method for forming a panel for an overhead door, the method comprising the steps of:

juxtaposing a panel skin material against a backer plate material in face to face contact;

simultaneously forming a recess in the panel skin material and a corresponding recess in the backer plate material;

wherein the recess in the panel skin material is adapted and configured to receive therein a component of the overhead door mounted to the panel.

42. The method of claim 41 further comprising:

joining the panel skin material to the backer plate material.

43. The overhead door of claim 25 wherein the at least one recessed pocket extends less than the width of the door.

44. The overhead door of claim 36 wherein each of the recessed pockets extends less than the width of the door.

* * * * *

UNITED STATES PATENT AND TRADEMARK OFFICE

CERTIFICATE OF CORRECTION

PATENT NO. : 7,201,207 B2
APPLICATION NO. : 10/949138
DATED : April 10, 2007
INVENTOR(S) : John A. Colston and Jeffrey W. Stone It is certified that error appears in the above-identified patent and that said Letters Patent is hereby corrected as shown below:

In column 2, line 60, “With” should read -- with --.

In column 4, lines 42-44, “Referring particularly to FIGS. 1, 3, 4, and 16 each panel 14 according to one embodiment in this invention includes a front skin 34 defining” should be deleted.

In column 7, line 10 claim 1, “hinge coupled” should read -- hinge pin coupled --.

In column 8, line 22 claim 17, “comprises;” should read -- comprises: --.

Signed and Sealed this

Nineteenth Day of February, 2008

JON W. DUDAS
*Director of the United States Patent and Trademark Office*